US011040825B2

(12) United States Patent
Grip

(10) Patent No.: US 11,040,825 B2
(45) Date of Patent: Jun. 22, 2021

(54) CARGO CONTAINER

(71) Applicant: THE BOEING COMPANY, Chicago, IL (US)

(72) Inventor: Robert Erik Grip, Rancho Palos Verdes, CA (US)

(73) Assignee: THE BOEING COMPANY, Chicago, IL (US)

( * ) Notice: Subject to any disclaimer, the term of this patent is extended or adjusted under 35 U.S.C. 154(b) by 117 days.

(21) Appl. No.: 16/386,829

(22) Filed: Apr. 17, 2019

(65) Prior Publication Data

US 2020/0331694 A1 Oct. 22, 2020

(51) Int. Cl.
*B65D 90/00* (2006.01)
*B65D 88/12* (2006.01)

(52) U.S. Cl.
CPC ..... *B65D 90/0066* (2013.01); *B65D 88/12* (2013.01); *B65D 90/008* (2013.01)

(58) Field of Classification Search
CPC .. B65D 90/0066; B65D 88/12; B65D 90/008; B65D 1/24; B65D 1/36; B65D 5/46064; B65D 5/46184; B65D 5/48006; B65D 5/48012; B65D 5/48014; B65D 5/48036; B65D 5/48042; B65D 5/50; B65D 7/065; B65D 25/04; B65D 25/082; B65D 25/085; B65D 25/087; B65D 81/32; B65D 85/328
USPC ..... 220/520, 557, 531, 500, 1.5, 560.07, 220/560.11, 4.2, 8, 6, 666; 206/736, 776, 206/773; 217/12, 43 R, 43 A
See application file for complete search history.

(56) References Cited

U.S. PATENT DOCUMENTS 1,038,644 A * 9/1912 Phin ..... 206/459.5
3,720,346 A * 3/1973 Cypher ..... B65F 1/1607 220/533
4,793,548 A * 12/1988 Ross ..... B65D 5/48038 217/31
4,978,018 A * 12/1990 Wood ..... B65F 1/0046 220/531
5,062,540 A * 11/1991 Jenkins ..... B65F 1/0046 211/131.1
6,105,654 A * 8/2000 Martel ..... F25D 23/069 16/225
7,004,698 B1 * 2/2006 Salazar ..... B60R 7/005 410/118
8,413,831 B2 * 4/2013 Nolan ..... B65D 21/068 220/7

(Continued)

*Primary Examiner* — Kareen K Thomas
(74) *Attorney, Agent, or Firm* — Patterson + Sheridan, LLP

(57) ABSTRACT

Certain aspects of the present disclosure provide a container, including: a floor; a plurality of vertical walls coupled to the floor; a ceiling coupled to the plurality of vertical walls; a first horizontal gate coupled to a first vertical wall of the plurality of vertical walls and comprising a first plurality of foldable portions; a second horizontal gate coupled to a second vertical wall of the plurality of vertical walls and comprising a second plurality of foldable portions; a third horizontal gate coupled to a third vertical wall of the plurality of vertical walls and comprising a third plurality of foldable portions; and a first vertical gate coupled to the ceiling and comprising a fourth plurality of foldable portions, wherein, when extended, the first horizontal gate, the second horizontal gate, the third horizontal gate, and the first vertical gate form a plurality of separate cargo volumes.

23 Claims, 11 Drawing Sheets

(56) References Cited

U.S. PATENT DOCUMENTS

| | | | | |
|---|---|---|---|---|
| 8,602,243 | B2 * | 12/2013 | Hunter | B65D 25/005 220/6 |
| 9,205,962 | B2 * | 12/2015 | Holderby | F25D 3/08 |
| 10,336,504 | B2 * | 7/2019 | Prezecki, II | B65D 25/06 |
| 2004/0262319 | A1 * | 12/2004 | Fisher | F25D 3/08 220/592.03 |
| 2011/0174824 | A1 * | 7/2011 | Potts | A45C 7/0077 220/531 |
| 2011/0290796 | A1 * | 12/2011 | Burgess | B65D 21/04 220/23.2 |
| 2014/0001082 | A1 * | 1/2014 | Ritzberger | B65D 25/04 206/600 |
| 2014/0103033 | A1 * | 4/2014 | Beckman | B65D 43/0212 220/4.01 |
| 2015/0151877 | A1 * | 6/2015 | Gallanosa, II | B65D 25/06 220/531 |

* cited by examiner

CARGO CONTAINER

INTRODUCTION

Aspects of the present disclosure relate to cargo containers, such as those used in commercial vehicles.

Pallets are widely used for shipments of products around the world by means of a variety of vehicles, such as aircraft, watercraft, tractor trailers, trains, and others. Because of their ubiquity, parties in the supply chain, from shipper, to shipping company, to receiver are generally accustomed to dealing with pallets and thus have tools and procedures for utilizing pallets.

Unfortunately, pallets are not flight worthy and cannot be used in aircraft absent additional accommodations. Consequently, shippers are generally required to offload cargo from pallets prior to transport by aircraft so that the cargo may be properly stowed in a flightworthy manner. For example, the cargo may be transferred to aircraft-specific packing pallets or unit load devices (ULDs) that lock into place and include suitable containment elements. However, the aircraft-specific packing trays stay with the aircraft, so the cargo must be unloaded from the aircraft and often packed back onto pallets for delivery to a final destinations. This procedure requires significant additional time and manpower expense, and also subjects the cargo to potential damage from the unpacking and repacking, which exposes the shipping company to damage liability.

Further, in some cases it is not practical to unload cargo from a pallet for shipment in another manner. In such cases, a general purpose container may be used to contain the pallet, but various compromises may arise by such use. For example, existing containers, such as ISO containers, may not match the geometry of pallets and thus space may be wasted in the container. Moreover, the wasted space creates a pallet containment problem that must be remedied by manually introducing additional containment means, such as space fillers, tie downs, netting, and the like. Thus, packing pallets in another general-purpose container generally leads to lost shipping capacity and lost revenue opportunity for this shipping company.

Accordingly, what is needed are improved cargo containers for shipping pallets in an airworthy fashion.

BRIEF SUMMARY

Certain embodiments provide a container, including: a floor; a plurality of vertical walls coupled to the floor; a ceiling coupled to the plurality of vertical walls; a first horizontal gate coupled to a first vertical wall of the plurality of vertical walls and comprising a first plurality of foldable portions; a second horizontal gate coupled to a second vertical wall of the plurality of vertical walls and comprising a second plurality of foldable portions; a third horizontal gate coupled to a third vertical wall of the plurality of vertical walls and comprising a third plurality of foldable portions; and a first vertical gate coupled to the ceiling and comprising a fourth plurality of foldable portions, wherein, when extended, the first horizontal gate, the second horizontal gate, the third horizontal gate, and the first vertical gate form a plurality of separate cargo volumes.

The following description and the related drawings set forth in detail certain illustrative features of one or more embodiments.

BRIEF DESCRIPTION OF THE DRAWINGS

The appended figures depict certain aspects of the one or more embodiments and are therefore not to be considered limiting of the scope of this disclosure.

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Figure 1:
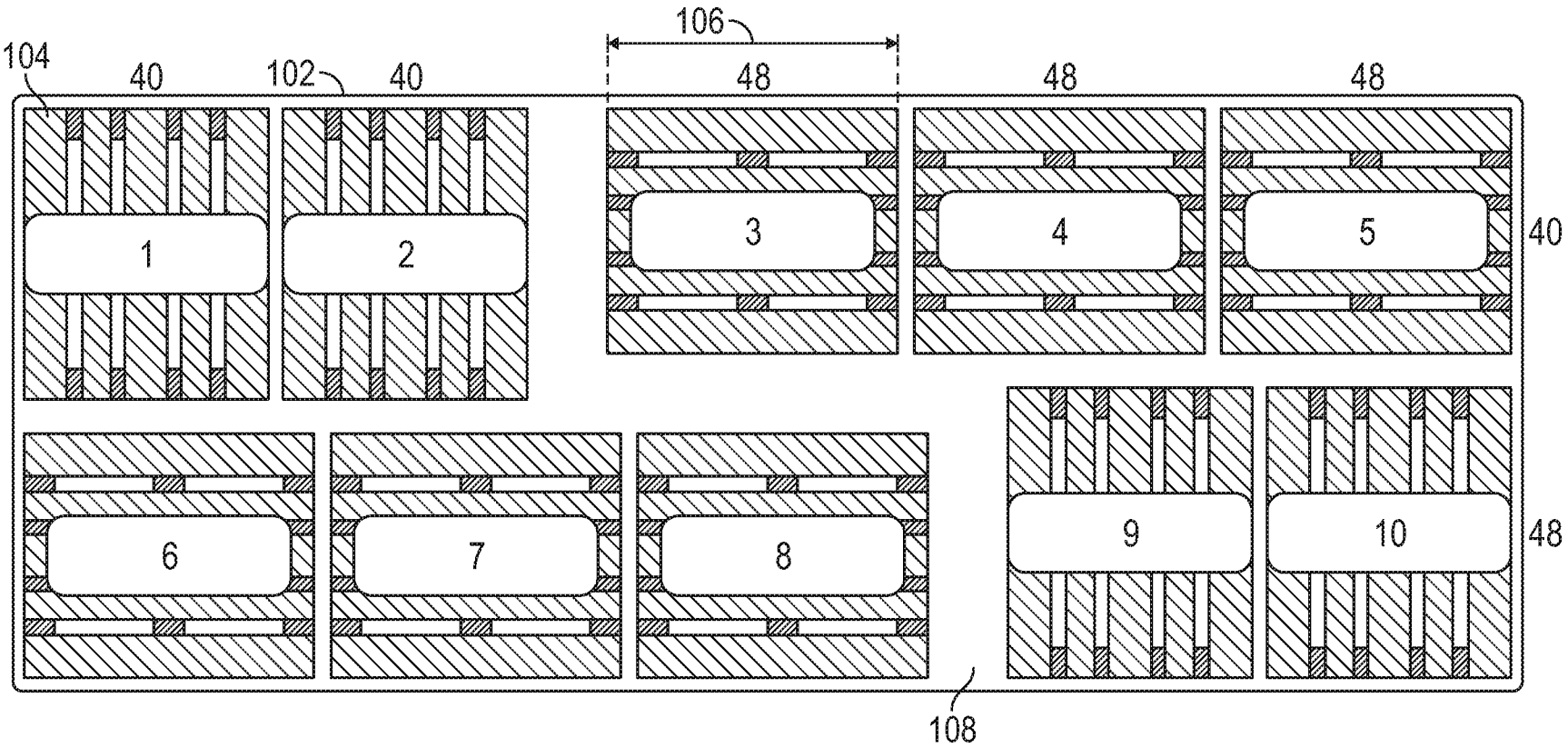
FIG. 1 depicts an examples of a general purpose container packed with pallets.

Aspects of the present disclosure provide improved cargo containers for shipping pallets in an airworthy fashion.

Shipping pallets are a widely used method for shipping products around the world. Though the size of pallets used worldwide does vary, the size of shipping pallets used within various regions tends to be more consistent, which contributes to their widespread use. For example, North America generally uses 40 inch by 48 inch or 42 inch by 42 inch pallets. Europe generally uses 1000 mm by 1200 mm pallets, which are very nearly the same size as the 40 inch by 48 inch pallets common in North America, as well as 1067 mm by 1067 mm pallets (42 inch by 42 inch) and 800 mm by 1200 mm pallets. Asia uses 1000 mm by 1200 mm pallets, 1067 mm by 1067 mm pallets (42 inch by 42 inch), and 1100 mm by 1100 mm pallets. Australia generally uses 1165 mm by 1165 mm pallets. These are just some examples.

While various regions and countries use various sizes of pallets regularly, the shipment containers in which the pallets are often packaged for transport on transport vehicles, such as aircraft, watercraft, trains, tractor trailers, and others, are more standardized. For example, 9 foot 6 inch tall by 8 foot wide by 20 foot long or 40 foot long "ISO" containers, which may also be referred to as "high-cubes", as well as 8 foot tall by 8 foot wide by 40 foot containers are standard for use with transport vehicles (though other lengths are also in use, such as 24, 28, 44, 45, 46, 53, and 56 foot). This ensures that the containers may be used internationally more easily.

Unfortunately, relatively more standardized ISO containers and the relatively more variable pallets lead to varying levels of wasted floor space when such ISO containers are packed with pallets. For example, in a 40 foot ISO container, 40 inch by 40 inch containers will waste approximately 3.7% of the floor space; 1000 mm by 1200 mm pallets will waste approximately 6.7% of the floor space; 1165 mm by 1165 mm pallets will waste approximately 8.1% of the floor space; 1067 mm by 1067 mm (42 inch by 42 inch) pallets will waste approximately 11.5% of the floor space; 1100 mm by 1100 mm pallets will waste approximately 14% of the floor space; and 800 mm by 1200 mm pallets will waste approximately 15.2% of the floor space. Thus, in many cases, there is significant waste when transporting regionally standardized pallets in internationally standardized containers.

Moreover, as described above, if an ISO container is shipped by air, the wasted space in them also creates airworthiness issues because it is unsafe for the cargo in the ISO containers to move about in the unused space while in the air. For example, such movement can create shifts in center of gravity that affect the handling of the aircraft. To a lesser extent, the same condition can create issues for other vehicles carrying ISO containers, such as land and water-based crafts.

Described herein are improved cargo containers that allow for loading standard pallets in a secured fashion so that the cargo containers are airworthy. In particular, the improved cargo containers described herein include movable gates that improve structural qualities of the containers (e.g., structural rigidity) while also constraining the movement of the pallet cargo loaded therein. Further, the movability of the gates allows the cargo containers to be quickly and easily loaded using conventional equipment, such as pallet jacks. Further yet, the movable gates provide an easy means for segregating cargo loads and creating separated cargo volumes. In some implementations, such as described in more detail below, the improved cargo containers include additional features to assist with loading and unloading of pallet cargo, such as integral floor channels for directing pallets to specific locations and orientations.

Critically, the improved cargo containers described herein allow standardized pallets to be used in aircraft without unloading and loading the cargo or using aircraft-specific cargo containers, as in conventional methods. Thus, the improved cargo containers described herein may improve the efficiency and therefore profitability of shipping operations as well as the safety of the shipping operation itself (e.g., the flying of a transport aircraft carrying the cargo).

Example ISO Containers Loaded with Pallets

FIG. 1 depicts an example of an arrangement of 48 inch by 40 inch pallets (e.g., 104) in a 20 foot (external dimension) cargo container 102. A similar pattern might be applied to a 40 foot container.

As is clear in this example, the dimensions of the pallets are such that they cannot be fit two-wide on their long sides 106 (48 inches in this example) in container 102, and they also cannot be fit five-long on their long side 106 either. Thus, a staggered arrangement of pallets is necessary, which leaves a significant amount of free space 108 available. The free space leaves the pallets unconstrained, and therefore container 102 would not be considered flightworthy and could not be loaded into a transport aircraft in this arrangement without special arrangements being made to restrain the cargo.

Conventionally, in cases such as depicted in FIG. 1, the cargo on the pallets loaded into container 102 would have to be offloaded from the pallets and stowed in a flightworthy manner in an aircraft instead of loaded into the aircraft in container 102. As above, these additional procedures require significant time and cost, and expose a shipper to the possibility of damage during the unpacking and loading onto the aircraft and then the unloading and repacking after coming off the aircraft.

Example Improved Cargo Containers

Figure 2A:
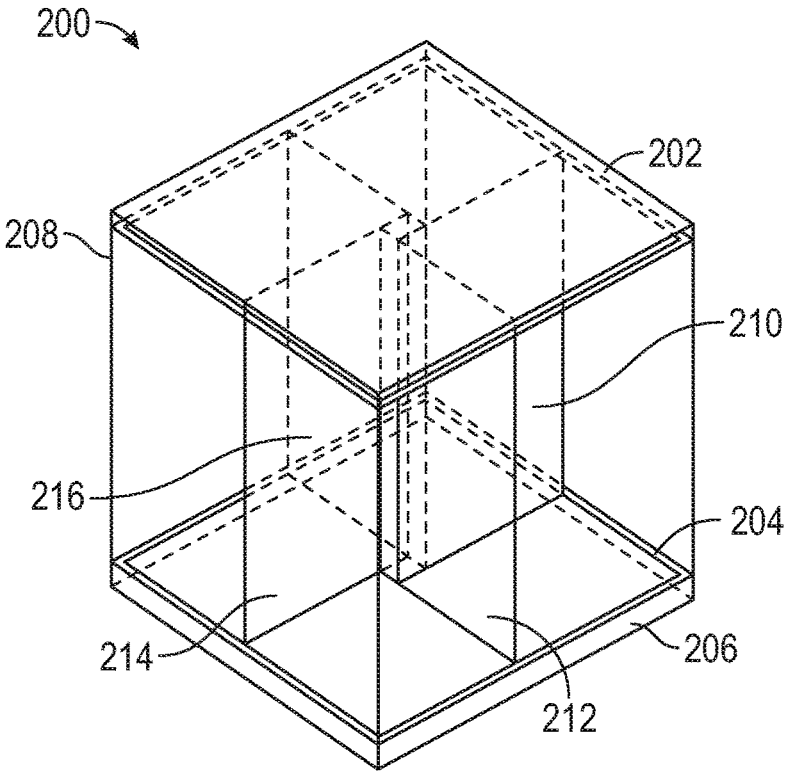
FIGS. 2A-2C depict examples of an improved container configured to retain pallets.

FIG. 2A depicts an isometric view of a container design configured to resolve the issues described above with respect to FIG. 1.

In this example, container 200 comprises three fixed vertical walls (e.g., 208), which are coupled between base 206 and roof 202. Floor 204 may be integral with, or may reside upon base 206. The fixed vertical walls, which may be referred to as external walls, may be made of a suitably strong material for shipment containers. For example, the outer walls may be made of a metal or metal alloy. In some examples, the outer walls may be made of a composite material for weight savings. In some examples, the outer walls may be constructed as sandwich panels, which is generally a structure made of three layers: a low-density core, and a thin skin-layer bonded to each side. Sandwich panels are useful in applications where a combination of high structural rigidity and low weight is required.

The fixed vertical outer walls may be coupled to floor 204 and base 206 (which in some implementations are one and the same), as well as to roof 202, which comprises an interior ceiling portion. Container 200 may also include loading doors, which are not shown in FIG. 2A, but which are shown in other figures described herein.

In this example, container 200 includes four "gates", which are movable, load-bearing partitions that allow the space of floor 204 to be partitioned into particular areas that correspond to the sizes of standard pallets, such as the 48 inch by 40 inch pallets discussed above.

Of the four total gates, container 200 includes three horizontal gates, 212, 214, and 216, which are gates that are coupled to inner walls, or structural components coupled to inner walls, and which articulate out from those inner walls. Though not depicted in FIG. 2A, as described further below, horizontal gates 212, 214, and 216 may comprises foldable portions or elements that allow the horizontal gates to fold compactly against the interior surface of the outer walls (e.g., 208).

In this example, container 200 also includes a vertical gate 210, which is coupled to roof 202, or to a structural member coupled to roof 202. Vertical gate 210 is configured to articulate out from an inner surface of roof 202. For example, as shown in more detail below, vertical gate 210 may be coupled to the roof instead of an inner wall on the side of container 200 where no fixed wall exists because there is instead a set of loading doors.

As depicted in FIG. 2A, when the four gates are extended, they form four separate cargo volumes, each protected from the other, and each configured to constrain cargo within the volume. The gates also form multiple structural members that distribute load throughout container 200 and increase its structural rigidity.

Figure 2B:
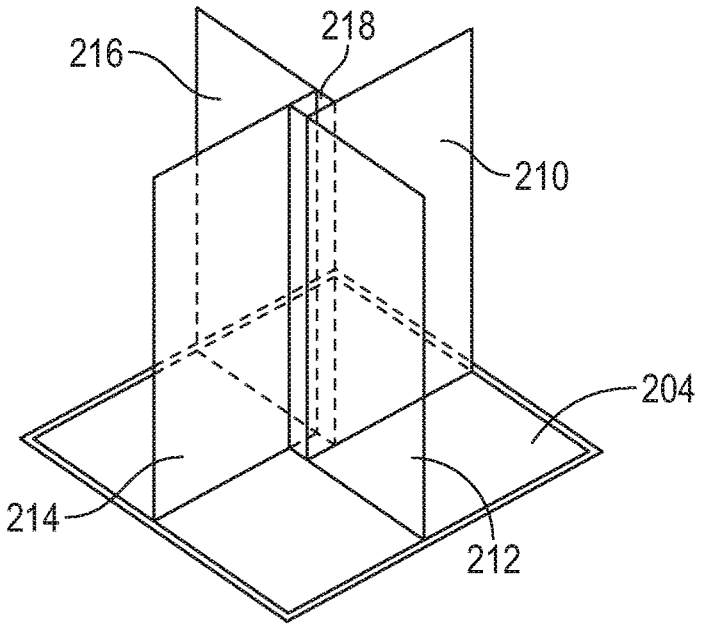

FIG. 2B depicts aspects of the same container 200, but with certain features removed to reveal additional details.

In particular, when horizontal gates 212, 214, and 216 are extended, as well as vertical gate 210, a support column 218 is formed between the floor 204 and the ceiling of container 200. Support column 218 provides additional strength to container 200 to prevent deformation under heavy loads. Further, horizontal gates 212, 214, and 216 and vertical gate 210 may be latched to floor 204 and an inner surface (ceiling) of roof 202 of container 200 to provide even more rigidity and load carrying capacity for container 200. For example, each of the horizontal and vertical gates may act as sheer walls when latched or otherwise affixed to floor 204 and the inner surface (ceiling) of roof 202.

Figure 2C:
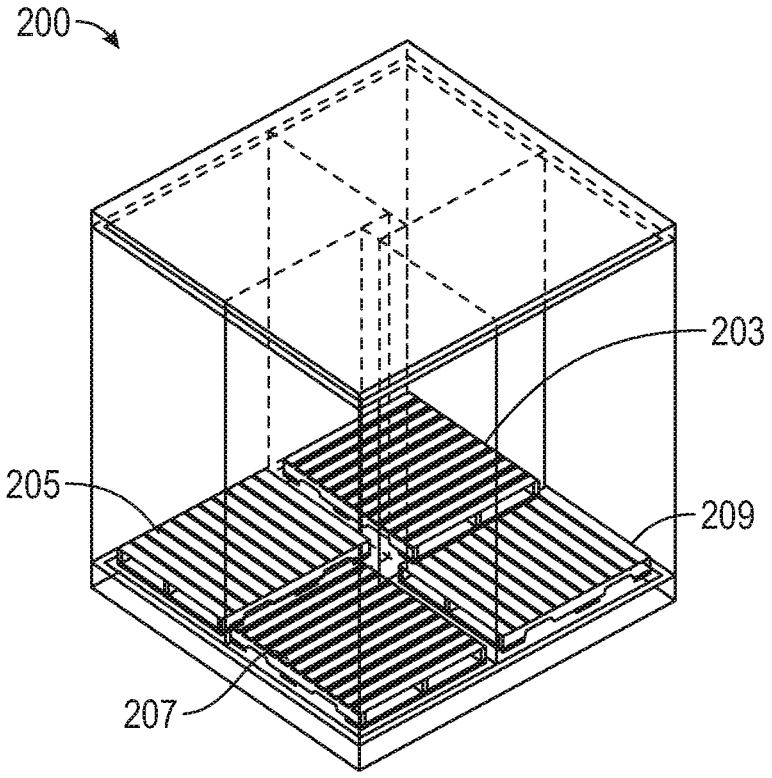

FIG. 2C depicts container 200 loaded with pallets in each of the cargo volumes created by the horizontal and vertical gates described above with respect to FIGS. 2A and 2B. As depicted, pallets 203, 205, 207, and 209 each fit within a floor space and volume that matches or closely approximates the length and width of the pallets. In this way, the pallets are safely constrained within container 300 despite the floor space issues described above with respect to FIG. 1.

With pallets 203, 205, 207, and 209 loaded in the configuration depicted in FIG. 2C, container 200 is flightworthy because cargo attached to the pallets (not shown) is constrained from lateral movement by the horizontal and vertical gates. Further, while not shown in FIG. 2C, additional structures may be used to constrain cargo in the vertical direction, such as tie-downs and the like. Thus, unlike conventional containers, container 200 may be loaded with conventional pallets and carry that cargo from origin to destination without needing unloading and reloading along the way.

In some implementations, container 200 may have a length of approximately 8 feet, a width of approximately 8 feet, and a height of approximately 8 feet. In this example, approximately means within plus or minus 2 inches. In other implementations, container 200 may have different dimensions. For example, in another implementation, container 200 may have a length of approximately 8 feet, a width of approximately 8 feet, and a height of approximately 5 feet and 4 inches (i.e., 64 inches). In some implementations, the height may be varied based on vehicle-specific considerations while keeping the same floorplan.

Load Bearing Structures in Improved Cargo Containers

Figure 3A:
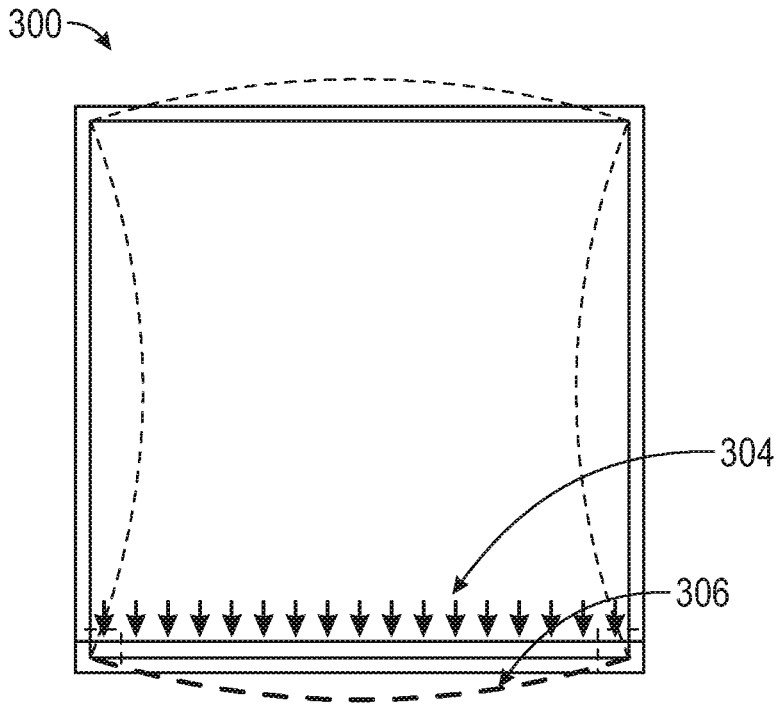
FIG. 3A depicts an example of container deformation under load.

FIG. 3A depicts an example of a container 300 without the horizontal or vertical gates. Notably, when a sufficient load is placed on the floor (e.g., applied load 304), then the exterior shape of container 300 will significantly deflect under the load.

Figure 3B:
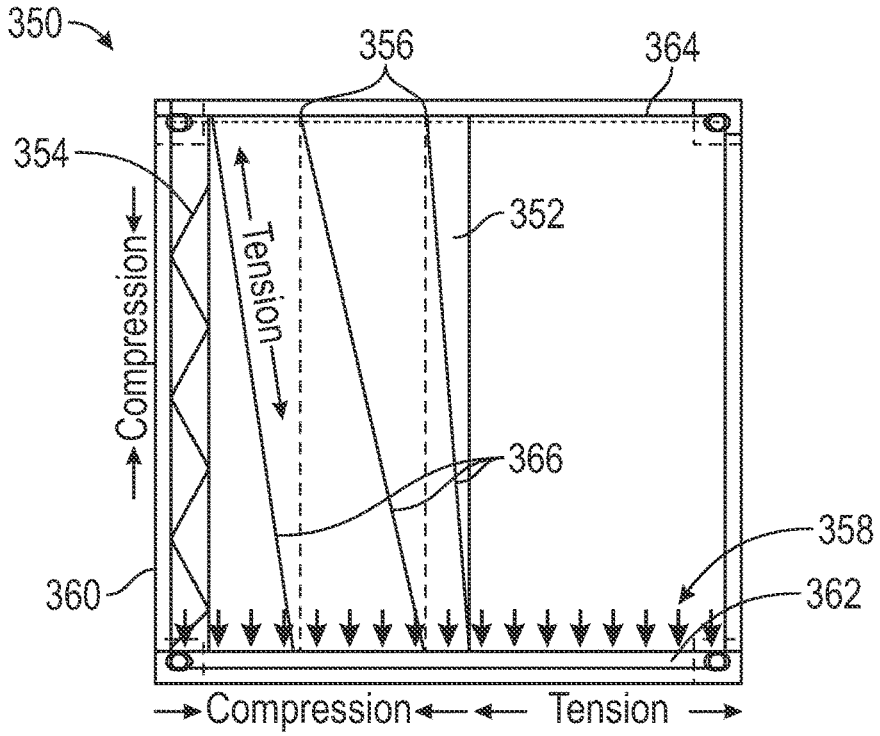
FIG. 3B depicts an example of structural features of an improved container.

FIG. 3B depicts a side view of an example improved cargo container 350, such as described above with respect to FIGS. 2A-2C.

In FIG. 3B, a single horizontal gate 352 is shown in an extended position. The hinges 356 of the unfolded horizontal gate are indicated in dashed lines. Though not depicted in FIG. 3B, horizontal gate 352 may be latched to both the floor 362 and the ceiling 364 of container 350, which increases the structural rigidity of container 350.

In this implementation, horizontal gate 352 is coupled to a vertical post 360 by hinges allowing for articulation of horizontal gate 352. Vertical post 360 helps to carry the compression load created by horizontal gate's 352 configuration as a load bearing structure.

Vertical post 360 may be mounted to or otherwise integral with the fixed vertical wall (or sidewall) of container 350. Beneficially, vertical post 360 allows for a strong structural member to support horizontal gate 352 without having to increase the weight of the entire sidewall of container 350. Thus, container 350 may be very strong, but still maintain a relatively low tare (or unladen) weight so that net weight (i.e., cargo) is maximized.

In this implementation, horizontal gate 352 also includes a truss structure 354 in one of its foldable portions. Truss structure 354 helps to resist buckling from the compression created by area load 358 pushing on floor 362, which pulls on horizontal gate 352, which in-turn pulls on ceiling 364, which in-turn compresses the fixed vertical wall of container 350. Truss structure 354 may be coupled to a portion of horizontal gate 352, or it may be integral with horizontal gate 352, such as within a frame forming one of the foldable portions of horizontal gate 352.

In this implementation, horizontal gate 352 also includes diagonal support members 366 within the folding portions of horizontal gate 352. These diagonal support members may help resist the tension created by load 358 pushing on floor 362 and pulling against the attachment points (e.g., hinges) of horizontal gate 352 to vertical post 360. In some implementations, diagonal support members 366 may comprise tension cables, which are lightweight and strong, while in others diagonal support members 366 may comprise solid structures.

Notably, container 350 is depicted with a single horizontal gate 352 extended, but similar structural features as described above may be found in one or more of the horizontal gates to maximize structural rigidity and load capacity of container 350. Similar structural features may also be implemented in vertical gates.

Further, while several structural enhancement features are shown, such as truss structure 354, diagonal support members 366, and vertical post 360, these are optional features that may be implemented based on use case. For example, one or more of these features may be selectively implemented based on the expected load capacity of container 350.

Extending Gates and Loading Improved Cargo Containers

Figure 4A:
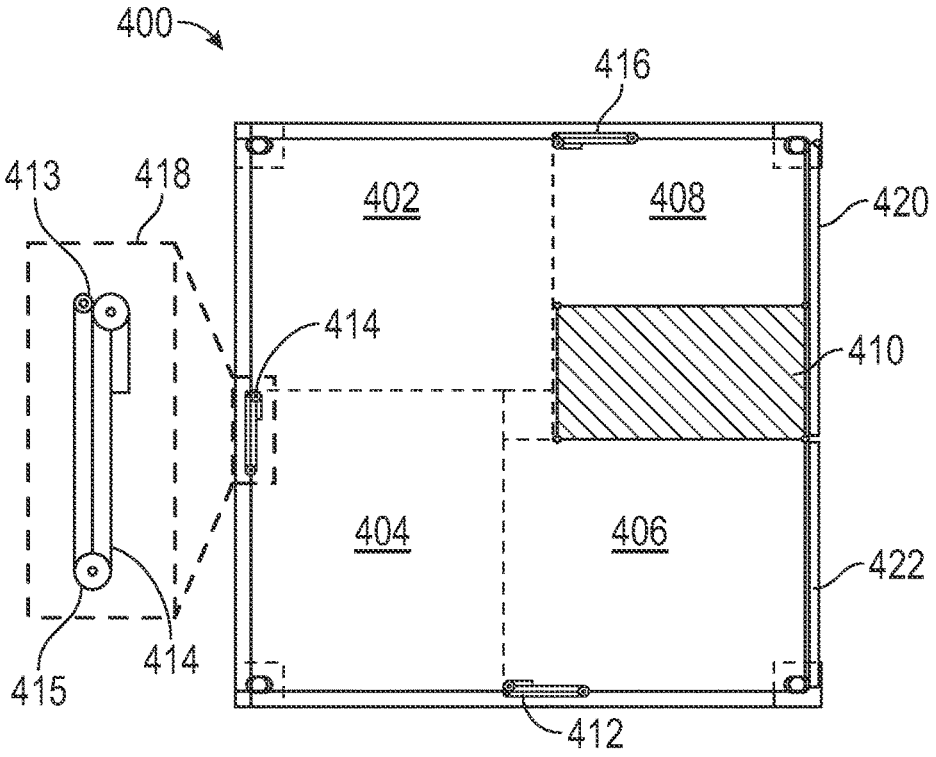
FIGS. 4A-4M depict example configurations of an improved container.

FIG. 4A depicts a plan view of an improved cargo container 400.

Cargo container 400 includes cargo areas 402, 404, 406, and 408, which are demarcated by the dashed lines because in this view, each of the horizontal and vertical gates are stowed away.

In particular, horizontal gates 412, 414, and 416 are each folded in multiple foldable portions (or foldable sections) and stowed against a fixed vertical wall. Cutout 418 shows an example configuration of horizontal gate 414 in a folded configuration. Horizontal gate 414 includes an attachment hinge 413, which may attach directly to the fixed vertical wall, or to a vertical post such as described above with respect to FIG. 3B.

Horizontal gate 414 also includes folding hinges 415, which allow horizontal gate 414 to be folded into a more compact dimension. When in a folded position, horizontal gate 414 may be stowed compactly against the fixed vertical wall. Notably, whereas a single panel gate mounted along a wall can only be as long as the distance between the mounting point (e.g., the wall hinge) and the perpendicular wall in the direction of the stowage direction, a foldable, multiple-portion wall can be folded into a shorter length for stowage and extended to a longer length for restraining cargo and providing the structural benefits discussed above in FIG. 3B.

In some implementations, horizontal folded gates 412, 414, and 416 fit into recesses within the fixed vertical walls of container 400 so as to be primarily flush when stowed. In this way, the maximum cargo area is available for container 400 when the folding gates are not being used. This gives container 400 multiple use cases.

Vertical gate 410 is also folded into multiple foldable portions and stowed against the ceiling in this embodiment. For example, vertical gate 410 may be latched to the ceiling once folded to retain it from swinging down.

Figure 4B:
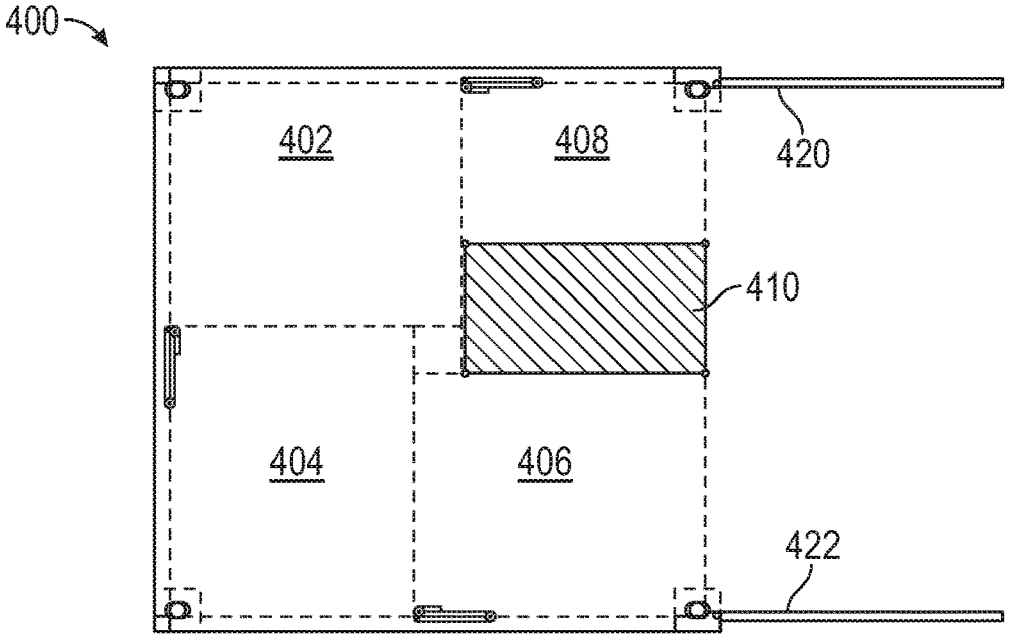

FIG. 4B shows the same features as FIG. 4A, but with loading doors 420 and 422 opened. FIG. 4B may represent an initial loading configuration of container 400.

Figure 4C:
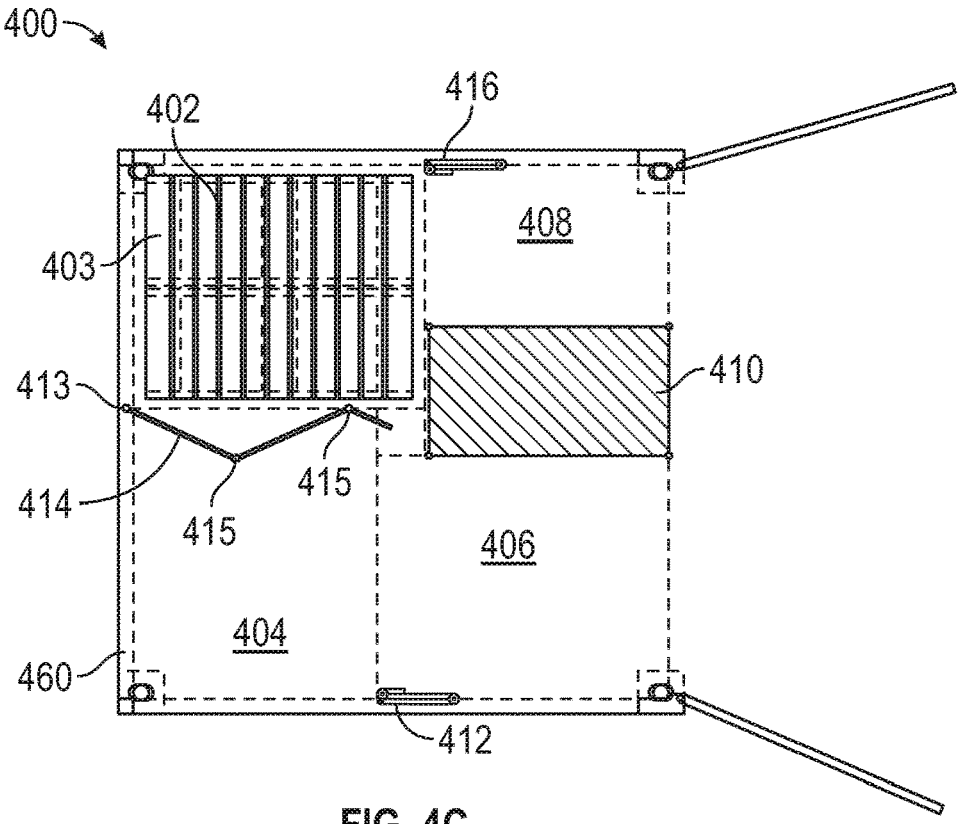
Figure 4D:
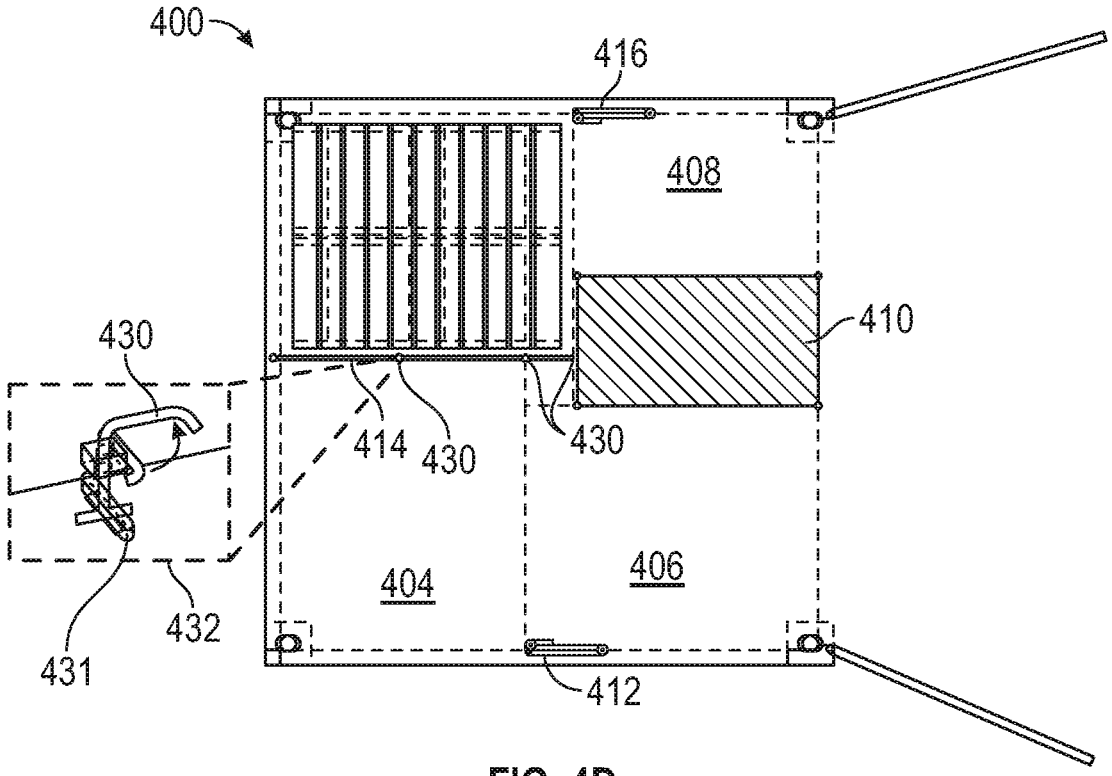

FIG. 4C depicts a pallet 403 loaded into cargo area 402. Once pallet 403 has been loaded, horizontal gate 414 may be unfolded and extended. FIG. 4C depicts horizontal gate partially unfolded and coupled to a fixed vertical wall of container 400 by wall hinge 413. Though not depicted, horizontal gate 414 may be coupled to a structural vertical post in the fixed vertical wall FIG. 4D depicts horizontal gate 414 fully extended.

Once fully extended, horizontal gate 414 may be latched to the floor and/or ceiling by a variety of latches 430. In some implementations, there may be at least one latch per foldable portion of a horizontal gate on each of the floor side of the horizontal gate and the ceiling side of the horizontal gate. In other implementations, there may be more latches than the number of foldable portions of the horizontal gate.

Cutout 432 shows one example of a latch that fits into a cutout in the floor and can be turned into a locked position. In this example, the cutout in the floor is a type of latch catch, which in general is a structure meant to catch a latching mechanism of the latch (such as a bolt, or bar, or hook, or other structure configured to retain the latching mechanism to the latch catch). The same arrangement could be used to latch the gate to the ceiling. Alternative implementations may have latches in the floor and/or ceiling that latch onto features in the gates, such as latch catches. Many types of latches can be used in either configuration, such as sliding bolt latches, spring-loaded bolt latches, and others. Latching horizontal gate 414 to the floor and/or ceiling allows for horizontal gate 414 to be rigidly affixed to those structures and to thereby provide increased structural rigidity for container 400.

Figure 4E:
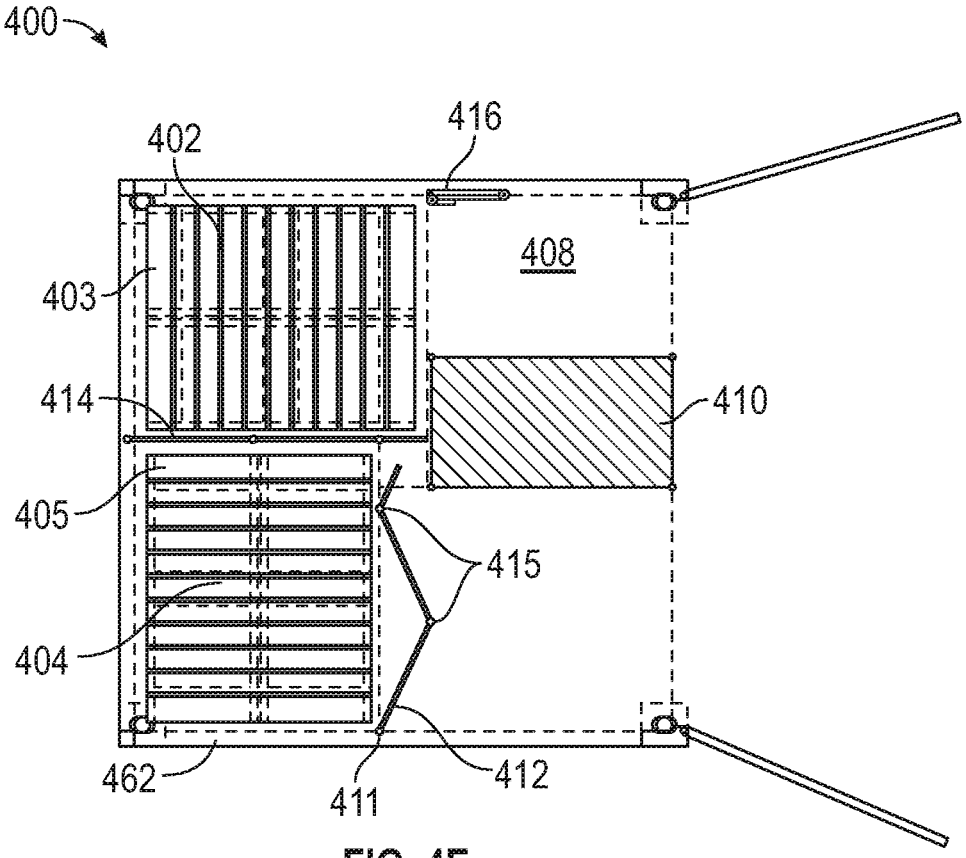

FIG. 4E depicts a pallet 405 loaded into cargo area 404. Notably, pallet 405 is in a different orientation in cargo area 404 as compared to pallet 403 in cargo area 402.

Further, horizontal gate 412 is depicted partially extended. In particular, horizontal gate 412 is coupled to a fixed vertical wall of container 400 by a gate hinge and partially unfolded by folding hinges 415.

Figure 4F:
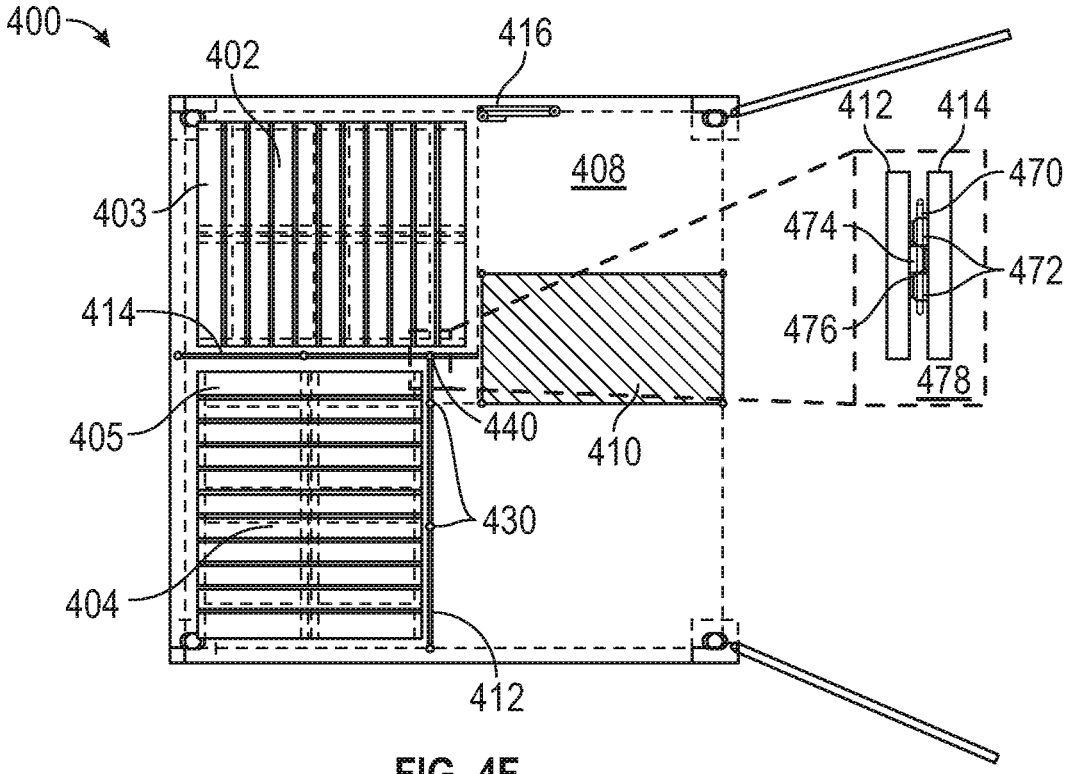

FIG. 4F depicts horizontal gate 412 fully extended and latched to the floor and ceiling via latches 430. As depicted, horizontal gate 412 has a length sufficient for it to interface with horizontal gate 414. In this implementation, horizontal gate 412 is latched to horizontal gate 414 via gate-to-gate latches 440. By latching horizontal gate 412 to horizontal gate 414, the load on the gates may be shared through their physical interface, therefore giving the gated enclosures (e.g., around cargo area 404) more structural strength and rigidity.

Cutout 478 depicts one example of a gate-to-gate latch 440, which in this example latches horizontal gate 412 to horizontal gate 414. In this example, latch 440 includes a plurality of fittings 472 and 474 which interlock with each other. Each of fittings 472 and 474 includes a hole that allows pin 470 to slide into place and couple gates 412 and 414 together. In this example, the tight fit of interlocking fittings 472 and 474 enables vertical shear load transfer between gates 412 and 414. Further, each of fittings 472 and 474 include chamfered portions 476, which allows fittings 472 and 474 to interlock more easily, especially when cargo loads are already acting on the structure of container 400.

Cutout 478 depicts just one example of a gate-to-gate latching mechanism 440. Other arrangements of numbers of fittings may be used in a similar manner to accomplish a similar result. Further, though a single gate-to-gate latch is depicted in cutout 478, a plurality of such latches may be used to latch gates together.

In other implementation, the gate-to-gate latches may comprise an extendable pin in one gate that slides into a slot in another gate. For example, the pin may be spring-loaded in order to automatically engage once in a correct position. In yet other implementations, gate-to-gate latches 440 may be the same types of latches as described above with respect to the floor and ceiling latches. Notably, these are just some examples, and other latching mechanisms capable of rigidly coupling gates together may be used.

Figure 4G:
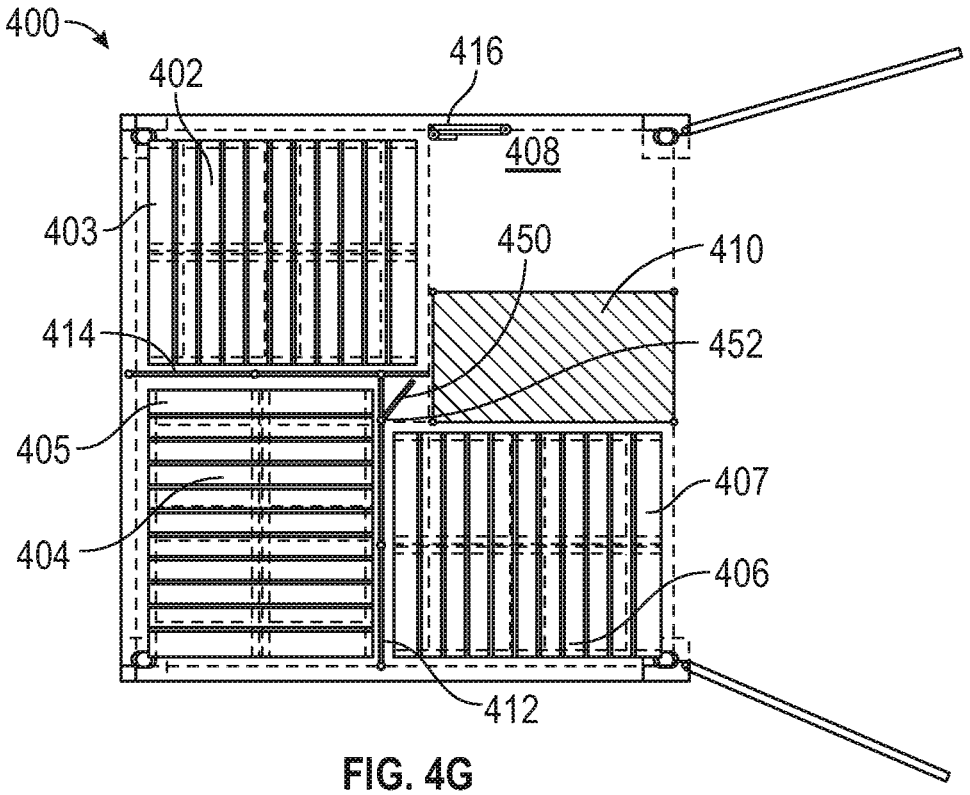

FIG. 4G depicts container 400 with pallet 407 positioned within cargo area 406. Further, a horizontal gate extension 450, which is coupled to horizontal gate 412 by an extension hinge 452, is depicted as partially extended; in other words, partially rotated around the axis of rotation of extension hinge 452.

Figure 4H:
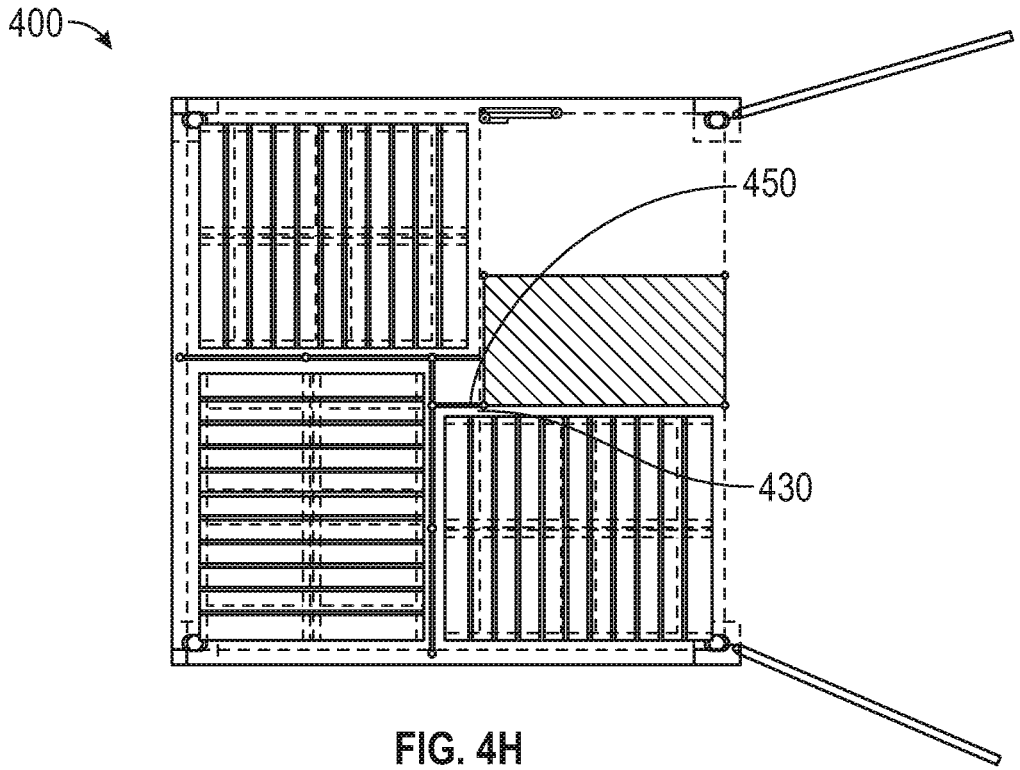

FIG. 4H depicts horizontal gate extension 450 fully extended and latched to the floor and/or ceiling via latches, as described above. In this implementation, horizontal gate extension 450 is used to form the third wall of the support column because the width of vertical gate 410 does not reach to horizontal gate 412. This ensures that the extension of vertical gate 410 is uninhibited by cargo within cargo area 402.

Figure 4I:
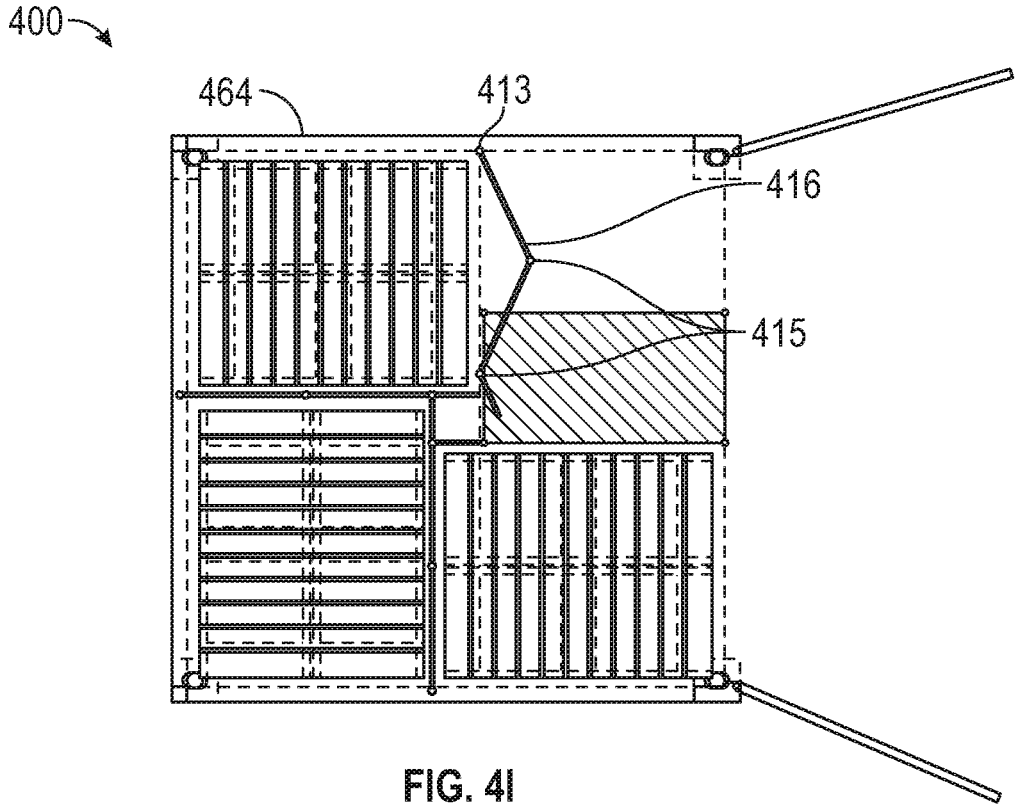

FIG. 4I depicts horizontal gate 416 partially extended. As with horizontal gates 412 and 414, horizontal gate 416 is coupled to a wall of container 400 via wall hinge 413. Further, foldable portions of horizontal gate 416 are partially unfolded via folding hinges 415.

Figure 4J:
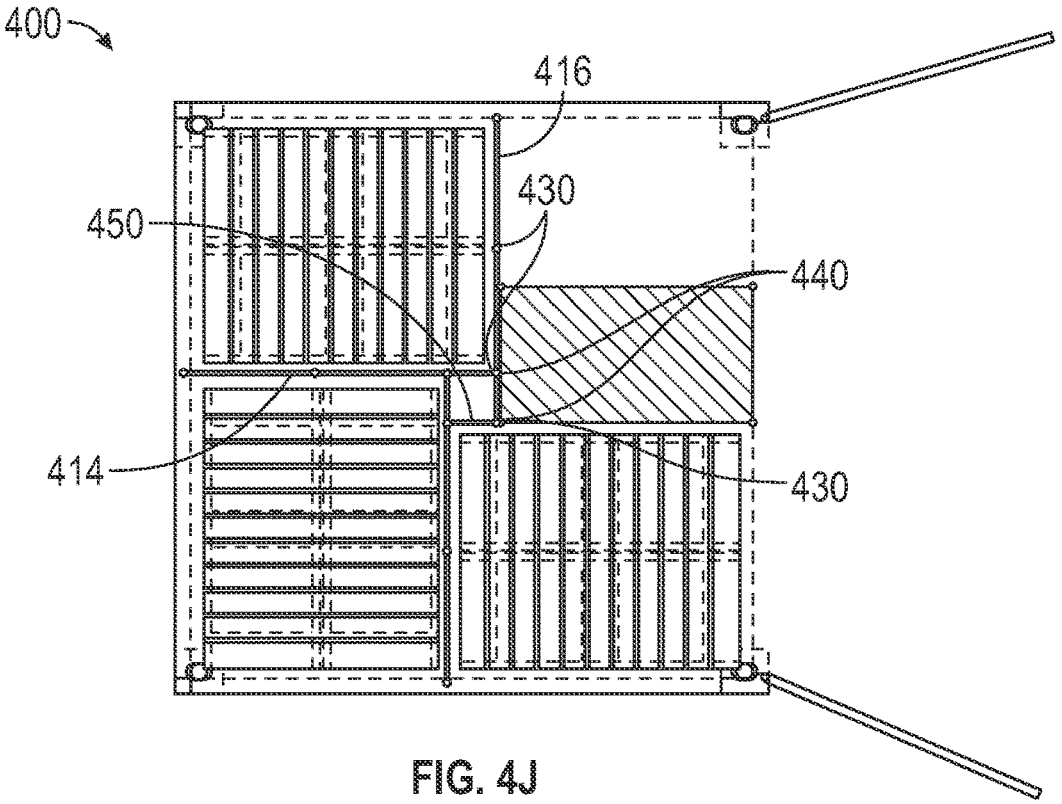

FIG. 4J depicts horizontal gate 416 fully extended and latched to the floor and/or ceiling by gate latches 430. Further, in this example horizontal gate 416 is latched to horizontal gate extension 450 via gate-to-gate latches as well as to horizontal gate 414 via gate-to-gate latches.

Figure 4K:
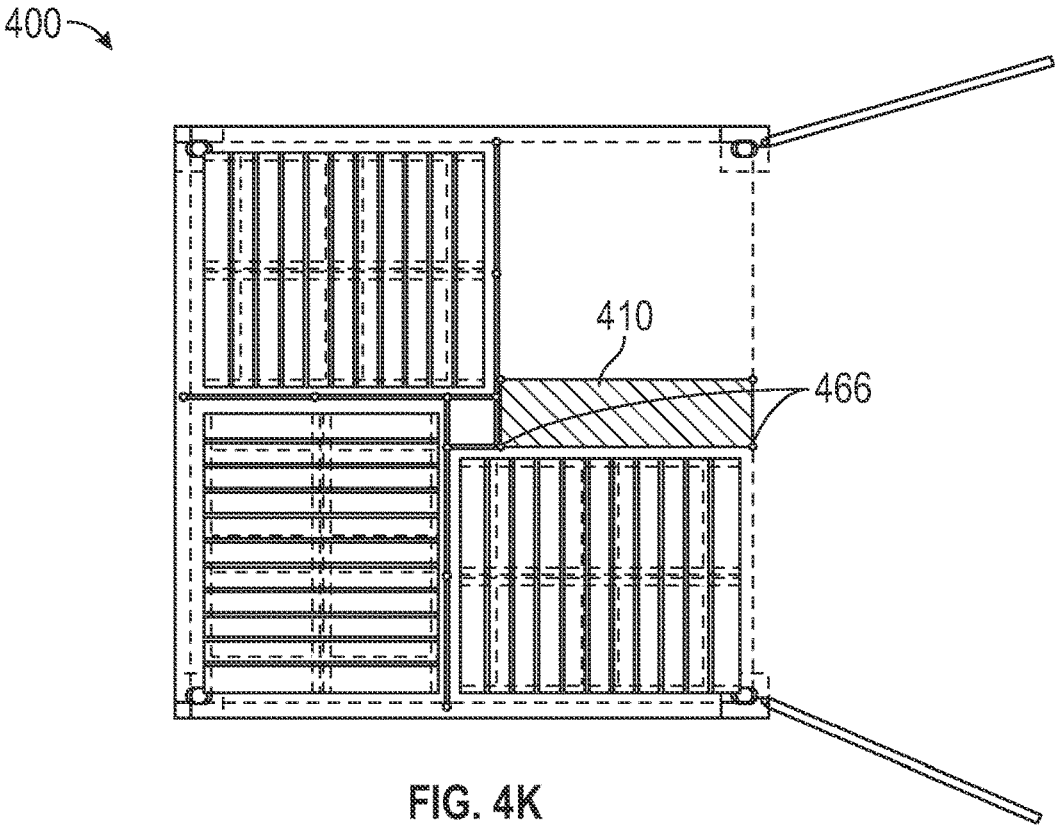

FIG. 4K depicts a partially extended vertical gate 410. In this implementation, vertical gate 410 may include several foldable portions, much like the horizontal gates, except configured to fold down from the ceiling of container 400 rather than out from a sidewall of container 400. However, in other implementation, vertical gate 410 may be a roll-down gate or another type of compactly stowable and extendable gate.

Figure 4L:
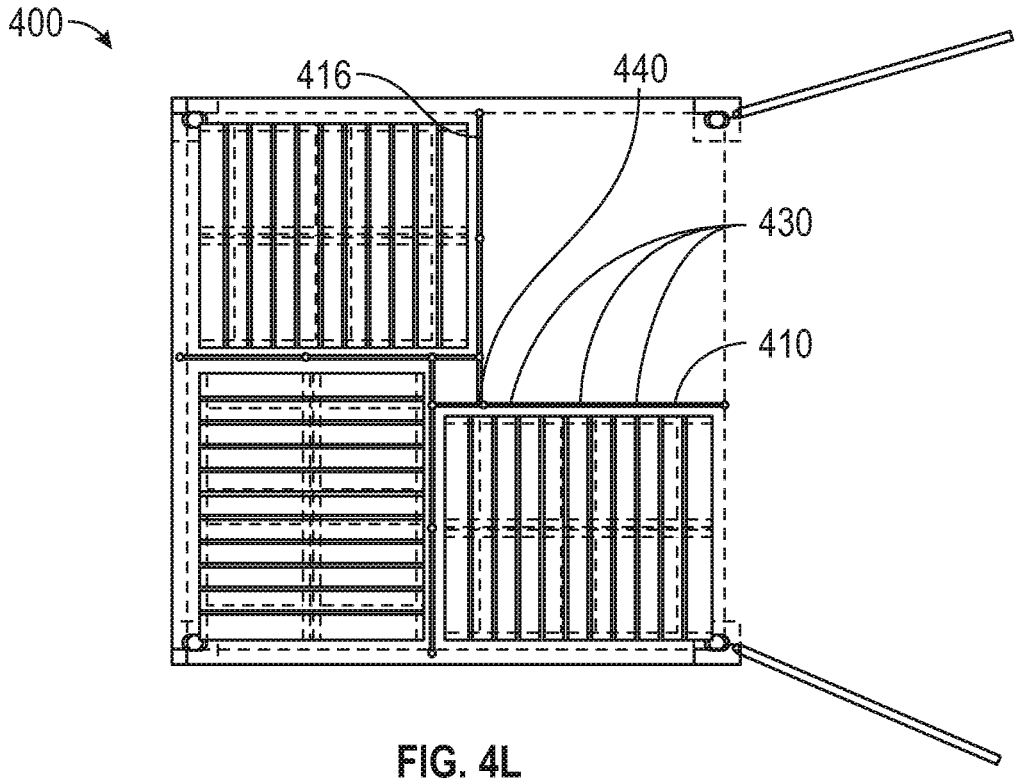

FIG. 4L depicts vertical gate 410 fully extended and latched to the floor via gate latches 430. Note that vertical gate 410 may not need to be latched to the ceiling in this case because vertical gate hinges already affix vertical gate 410 to the ceiling (or to a structural member coupled to or integral with the ceiling)

Figure 4M:
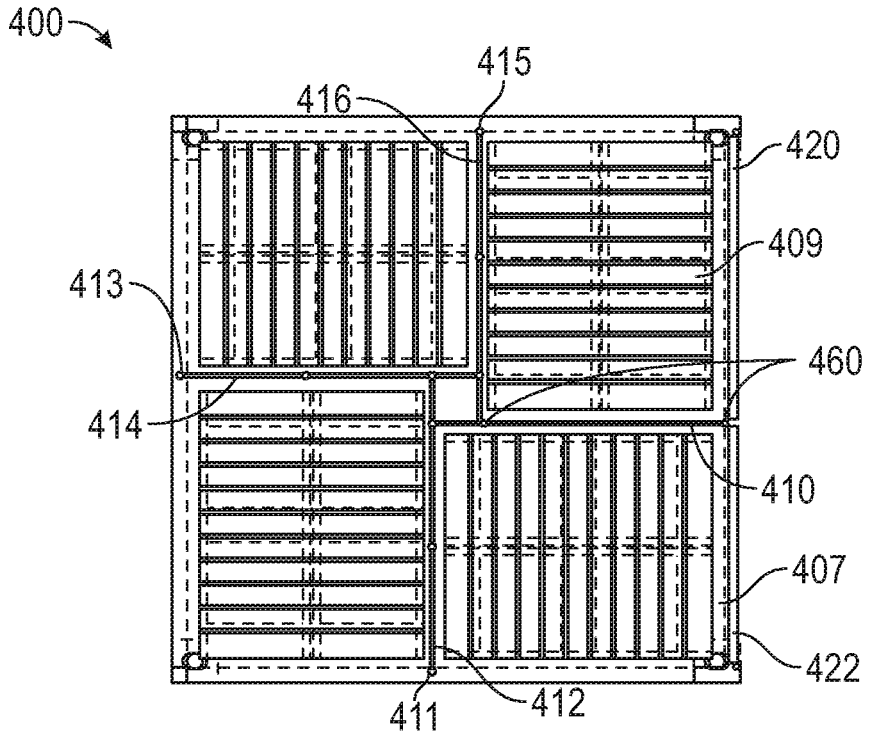

FIG. 4M depicts an overhead view of container 400 with pallets 303, 305, 307, and 309 loaded (in the same configuration as in FIG. 2C).

Notably, horizontal gates 412, 414, and 416 and vertical gate 410 are located in the free space between pallets when extended, and the gates act to provide lateral constraint to the loaded pallets.

FIG. 4M also depicts horizontal gate hinges 411, 413, and 414 for horizontal gates 412, 414, and 416, respectively. In this example, the horizontal gates are fully extended and supported by their hinges, which are coupled to the fixed vertical walls (or to structural members coupled to or integral with the fixed vertical walls). Similarly, vertical gate 410 is hung from vertical gate hinges 466, which are coupled to the ceiling of the container (not depicted).

FIG. 4M further depicts loading doors 420 and 422 latched closed so as to act as a fourth wall for container 400.

Notably, in this implementation, loading door 420 and loading door 422 are asymmetric in length. In particular, loading door 420 has a length matching the long-edge of pallet 409, which allows full loading to the floor space for pallet 409 when opened. Similarly, loading door 422 has a length matching the short side of pallet 407, which allows full loading to the floor space for pallet 407 when opened. The asymmetric lengths of loading doors 420 and 422 also allows each door to be latched to vertical gate 410, thus providing a shear path that maintains structural integrity and stiffness.

Additional Loading and Cargo Security Enhancements in Improved Cargo Containers

Figure 5A:
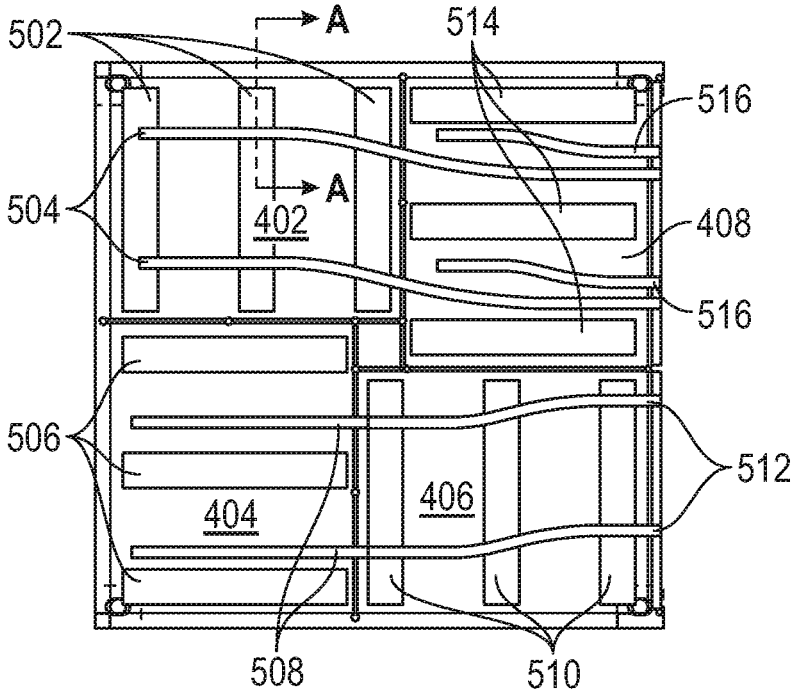
FIG. 5A-5B depicts additional features of an improved container.

FIG. 5A depicts additional enhancements to a cargo container such as those described in FIGS. 2A-2C and 4A-4M.

Conventionally, pallets such as those described herein may be loaded into a cargo container using a pallet moving tool, such as a pallet jack. A pallet jack normally has two forks configured to fit between three lower deck boards and recesses in the stringer boards. The two forks of a pallet jack normally have wheels or casters to enable movement of the pallet jack.

In FIG. 5A, the floor of container 500 includes pallet jack guide channels 504, 508, 512, and 516, each of which acts as a guide for a pallet jack's fork wheels. In other words, as a pallet jack's fork wheels roll into the pallet jack guide channels, the guide channels force the pallet jack to follow a track that will position the pallet in exactly the right location within the various cargo areas described above. Thus, pallet jack guide channels 504, 508, 512, and 516 may improve the loading speed of container 500 and reduce any cargo placement errors that may interfere with extension of gates, as described above in FIGS. 4A-4M.

Note that in FIG. 5A, the gates are depicted as a reference for the various cargo areas to which the pallet jack guide channels are directed.

Further depicted in FIG. 5A are pallet recesses configured to match the dimension and placement of lower deck boards on conventional pallets. When placed in these recesses, a pallet is further prevented from lateral movement, which contributes to the stability of palleted cargo in container 500 and thus to its airworthiness.

In the example implementation of FIG. 5A, pallet recesses 502 (top left) and 510 (bottom right) are in a first pallet orientation direction, and pallet recesses 506 and 514 are in a second pallet orientation direction, consistent with how the pallets are laid out in FIG. 4M.

Figure 5B:
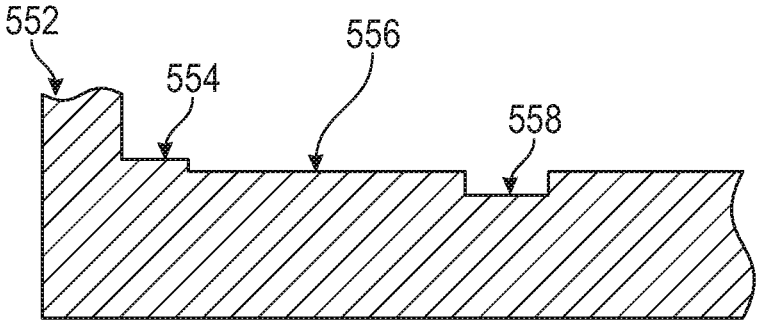

FIG. 5B depicts a cross-section of part of the floor area of FIG. 5A at line A-A. The cross-section depicts a container wall 552, such as wall 208 in FIG. 2A, a container floor 554, such as floor 204 in FIG. 2A, a pallet recess 556, such as pallet recesses 502, 506, 510, and 514 in FIG. 5B, and a pallet jack guide channel 558, such as pallet jack guide channels 504, 508, 512, and 516 in FIG. 5B.

Note that the dimensions in FIG. 5B are just one example, and others can be used.

EXAMPLE EMBODIMENTS

The following are example embodiments. Notably, the reference numerals in the examples below are merely examples. Further, even if single claim dependencies are indicated in the following examples, or in the claims below, all claim dependencies, including multiple claim dependencies, are included within the scope of the present disclosure.

Embodiment 1

A container, comprising: a floor (362); a plurality of vertical walls (460, 462, 464) coupled to the floor; a ceiling (364) coupled to the plurality of vertical walls; a first horizontal gate (414) coupled to a first vertical wall (460) of the plurality of vertical walls and comprising a first plurality of foldable portions; a second horizontal gate (412) coupled to a second vertical wall (462) of the plurality of vertical walls and comprising a second plurality of foldable portions; a third horizontal gate (416) coupled to a third vertical wall (464) of the plurality of vertical walls and comprising a third plurality of foldable portions; and a first vertical gate (410) coupled to the ceiling and comprising a fourth plurality of foldable portions, wherein, when extended, the first horizontal gate (414), the second horizontal gate (412), the third horizontal gate (416), and the first vertical gate (410) form a plurality of separate cargo volumes (402, 404, 406, 408).

Embodiment 2

The container of Embodiment 1, wherein: the first horizontal gate (414) is configured to latch (430) to the floor, the second horizontal (412) gate is configured to latch (430) to the floor, the third horizontal gate (416) is configured to latch (430) to the floor, and the first vertical gate (410) is configured to latch (430) to the floor.

Embodiment 3

The container of Embodiment 2, wherein: the first horizontal gate (414) is configured to latch (430) to the ceiling, the second horizontal (412) gate is configured to latch (430) to the ceiling, and the third horizontal gate (416) is configured to latch (430) to the ceiling.

Embodiment 4

The container of Embodiment 3, wherein the second horizontal gate (412) is configured to latch (440) to the first horizontal gate (414).

Embodiment 5

The container of Embodiment 4, wherein: the second horizontal gate (412) comprises a horizontal gate extension (450) coupled to the second horizontal gate (412) by one or more horizontal extension hinges (452), the horizontal gate extension (450) is configured to latch (430) to the floor, and the horizontal gate extension (450) is configured to latch (430) to the ceiling.

Embodiment 6

The container of Embodiment 5, wherein: the third horizontal gate (416) is configured to latch (440) to the first horizontal gate (414), and the third horizontal gate (416) is configured to latch (440) to the horizontal gate extension (450).

Embodiment 7

The container of Embodiment 6, wherein, when latched together, the first horizontal gate (414), the second horizontal gate (412), and the third horizontal gate (416) form a support column (218) in the container.

Embodiment 8

The container of Embodiment 7, wherein the first vertical gate (410) is configured to latch (440) to the third horizontal gate (416).

Embodiment 9

The container of Embodiment 1, wherein the floor (362) comprises a plurality of pallet jack guide channels (504, 508, 512, 516).

Embodiment 10

The container of Embodiment 9, wherein: a first pair of pallet jack guide channels (504) of the plurality of pallet jack guide channels is configured to guide a pallet jack to a first cargo area (402), a second pair (516) of pallet jack guide channels of the plurality of pallet jack guide channels (516) is configured to guide the pallet jack to a second cargo area (408), a third pair of pallet jack guide channels (512) of the plurality of pallet jack guide channels is configured to guide the pallet jack to a third cargo area (406); and a fourth pair of pallet jack guide channels (508) of the plurality of pallet jack guide channels is configured to guide the pallet jack to a fourth cargo area (404).

Embodiment 11

The container of Embodiment 1, wherein the floor comprises a plurality of pallet recesses (502, 506, 510, 514).

Embodiment 12

The container of Embodiment 11, wherein: a first set of pallet recesses (502) of the plurality of pallet recesses reside in a first cargo area (402) in a first pallet orientation direction, a second set of pallet recesses (506) of the plurality of pallet recesses reside in a second cargo area (404) in a second pallet orientation direction, a third set of pallet recesses (510) of the plurality of pallet recesses reside in a third cargo area (406) in the first pallet orientation direction, and a fourth set of pallet recesses (514) of the plurality of pallet recesses reside in a fourth cargo area (408) in the second pallet orientation direction.

Embodiment 13

The container of Embodiment 1, wherein: the first horizontal gate (414) is coupled to the first vertical wall (460) of the plurality of vertical walls by a first hinge (413) coupled to a first vertical post (360) coupled to the first vertical wall (460), the second horizontal gate (412) is coupled to the second vertical wall (462) of the plurality of vertical walls by a second hinge (411) coupled to a second vertical post (360) coupled to the second vertical wall (462), and the third horizontal gate (416) is coupled to the third vertical wall (464) of the plurality of vertical walls by a third hinge (413) coupled to a third vertical post (360) coupled to the third vertical wall (464).

Embodiment 14

The container of Embodiment 1, wherein: at least one of the first plurality of foldable portions in the first horizontal gate (414) comprises a first truss structure (354), at least one of the second plurality of foldable portions in the second horizontal gate (412) comprises a second truss structure (354), and at least one of the third plurality of foldable portions in the third horizontal gate (416) comprises a third truss structure (354).

Embodiment 15

The container of Embodiment 1, wherein: at least one of the first plurality of foldable portions in the first horizontal gate (414) comprises a first diagonal support structure (366), at least one of the second plurality of foldable portions in the second horizontal gate (412) comprises a second diagonal support structure (366), and at least one of the third plurality of foldable portions in the third horizontal gate (416) comprises a third diagonal support structure (366).

Embodiment 16

The container of Embodiment 2, wherein: the first horizontal gate (414) is configured to latch to the floor by one or more floor latch catches configured to enable latching by one or more of a plurality of floor latches coupled to the floor (362), the second horizontal gate (412) is configured to latch to the floor by one or more floor latch catches configured to enable latching by one or more of the plurality of floor latches coupled to the floor, the third horizontal gate (416) is configured to latch to the floor by one or more floor latch catches configured to enable latching by one or more of the plurality of floor latches coupled to the floor (362), and the first vertical gate (410) is configured to latch to the floor by one or more floor latch catches configured to enable latching by one or more of a plurality of floor latches coupled to the floor (362).

Embodiment 17

The container of Embodiment 2, wherein: the first horizontal gate (414) is configured to latch to the ceiling (364) by one or more ceiling latch catches configured to enable latching by one or more of a plurality of ceiling latches coupled to the ceiling (364), the second horizontal gate (412) is configured to latch to the ceiling by one or more ceiling latch catches configured to enable latching by one or more of the plurality of ceiling latches coupled to the ceiling (364), and the third horizontal gate (416) is configured to latch to the ceiling by one or more ceiling latch catches configured to enable latching by one or more of the plurality of ceiling latches coupled to the ceiling (364).

Embodiment 18

The container of Embodiment 1, further comprising: a first loading (420) door having a first length; and a second loading door (422) having a second length, different from the first length.

Embodiment 19

The container of Embodiment 1, wherein: the first plurality of foldable portions (414) comprises three foldable portions, the second plurality of foldable portions (412) comprises three foldable portions, and the third plurality of foldable portions (416) comprises three foldable portions.

Embodiment 20

The container of Embodiment 1, wherein: the container has a length of approximately 8 feet, the container has a width of approximately 8 feet, and the container has a height of approximately 8 feet.

Embodiment 21

The container of Embodiment 1, wherein: each of the first plurality of foldable portions is coupled to another foldable portion of the first plurality of foldable portions by one or more first horizontal gate hinges (415), each of the second plurality of foldable portions is coupled to another foldable portion of the second plurality of foldable portions by one or more second horizontal gate hinges (415), each of the third plurality of foldable portions is coupled to another foldable portion of the third plurality of foldable portions by one or more third horizontal gate hinges (415), and each of the fourth plurality of foldable portions is coupled to another foldable portion of the fourth plurality of foldable portions by one or more first vertical gate hinges (466).

Embodiment 22

A method of configuring a container, comprising: extending a first horizontal gate (414) coupled to a first vertical wall (460) of a plurality of vertical walls and comprising a first plurality of foldable portions; extending a second horizontal gate (412) coupled to a second vertical wall (462) of the plurality of vertical walls and comprising a second plurality of foldable portions; extending a third horizontal gate (416) coupled to a third vertical wall (464) of the plurality of vertical walls and comprising a third plurality of foldable portions; and extending a first vertical gate (410) coupled to the ceiling (364) and comprising a fourth plurality of foldable portions.

Embodiment 23

The method of Embodiment 22, further comprising: latching the first horizontal gate (414) to the floor; latching the second horizontal (412) gate to the floor; latching the third horizontal gate (416) to the floor; and latching the first vertical gate (410) to the floor.

Embodiment 24

The method of Embodiment 23, further comprising: latching the first horizontal gate (414) to the ceiling; latching the second horizontal (412) gate to the ceiling; and latching the third horizontal gate (416) to the ceiling.

Embodiment 25

The method of Embodiment 24, further comprising: latching the second horizontal gate (412) to the first horizontal gate (414).

Embodiment 26

The method of Embodiment 25, further comprising: extending a horizontal gate extension (450) coupled to the second horizontal gate (412) by one or more horizontal extension hinges (452); latching the horizontal gate extension (450) to the floor (430); and latching the horizontal gate extension (450) to the ceiling.

Embodiment 27

The method of Embodiment 26, further comprising: latching the third horizontal gate (416) to the first horizontal gate (414); and latching the third horizontal gate (416) to the horizontal gate extension (450).

Embodiment 28

The method of Embodiment 27, wherein, when latched together, the first horizontal gate (414), the second horizontal gate (412), and the third horizontal gate (416) form a support column (218) in the container.

Embodiment 29

The method of Embodiment 28, further comprising: latching the first vertical gate (410) to the third horizontal gate (416).

Embodiment 30

The method of Embodiment 22, wherein the floor (362) comprises a plurality of pallet jack guide channels (504, 508, 512, 516).

Embodiment 31

The method of Embodiment 30, further comprising: guiding a pallet jack to a first cargo area (402) via a first pair of pallet jack guide channels (504) of the plurality of pallet jack guide channels; stowing first cargo in the first cargo area (402) using the pallet jack; guiding the pallet jack to a second cargo area (408) via a second pair of pallet jack guide channels (516) of the plurality of pallet jack guide channels; stowing second cargo in the second cargo area (408) using the pallet jack; guiding the pallet jack to a third cargo area (406) via a third pair of pallet jack guide channels (512) of the plurality of pallet jack guide channels; stowing third cargo in the third cargo area (406) using the pallet jack; guiding the pallet jack to a fourth cargo area (404) via a fourth pair of pallet jack guide channels (508) of the plurality of pallet jack guide channels; and stowing fourth cargo in the fourth cargo area (402) using the pallet jack.

Embodiment 32

The method of Embodiment 30, wherein the floor comprises a plurality of pallet recesses (502, 506, 510, 514).

Embodiment 33

The method of Embodiment 32, wherein: a first set of pallet recesses (502) of the plurality of pallet recesses reside in a first cargo area (402) in a first pallet orientation direction, a second set of pallet recesses (506) of the plurality of pallet recesses reside in a second cargo area (404) in a second pallet orientation direction, a third set of pallet recesses (510) of the plurality of pallet recesses reside in a third cargo area (406) in the first pallet orientation direction, and a fourth set of pallet recesses (514) of the plurality of pallet recesses reside in a fourth cargo area (408) in the second pallet orientation direction.

Embodiment 34

The method of Embodiment 22, wherein: the first horizontal gate (414) is coupled to the first vertical wall (460) of the plurality of vertical walls by a first hinge (413) coupled to a first vertical post (360) coupled to the first vertical wall (460), the second horizontal gate (412) is coupled to the second vertical wall (462) of the plurality of vertical walls by a second hinge (411) coupled to a second vertical post (360) coupled to the second vertical wall (462), and the third horizontal gate (416) is coupled to the third vertical wall (464) of the plurality of vertical walls by a third hinge (413) coupled to a third vertical post (360) coupled to the third vertical wall (464).

Embodiment 35

The method of Embodiment 22, wherein: at least one of the first plurality of foldable portions in the first horizontal gate (414) comprises a first truss structure (354), at least one of the second plurality of foldable portions in the second horizontal gate (412) comprises a second truss structure (354), and at least one of the third plurality of foldable portions in the third horizontal gate (416) comprises a third truss structure (354).

Embodiment 36

The method of Embodiment 22, wherein: at least one of the first plurality of foldable portions in the first horizontal gate (414) comprises a first diagonal support structure (366), at least one of the second plurality of foldable portions in the second horizontal gate (412) comprises a second diagonal support structure (366), and at least one of the third plurality of foldable portions in the third horizontal gate (416) comprises a third diagonal support structure (366).

Embodiment 37

The method of Embodiment 36, wherein: the first horizontal gate (414) is configured to latch to the floor by one or more floor latch catches configured to enable latching by one or more of a plurality of floor latches coupled to the floor (362), the second horizontal gate (412) is configured to latch to the floor by one or more floor latch catches configured to enable latching by one or more of the plurality of floor latches coupled to the floor, the third horizontal gate (416) is configured to latch to the floor by one or more floor latch catches configured to enable latching by one or more of the plurality of floor latches coupled to the floor (362), and the first vertical gate (410) is configured to latch to the floor by one or more floor latch catches configured to enable latching by one or more of a plurality of floor latches coupled to the floor (362).

Embodiment 38

The method of Embodiment 37, wherein: the first horizontal gate (414) is configured to latch to the ceiling (364) by one or more ceiling latch catches configured to enable latching by one or more of a plurality of ceiling latches coupled to the ceiling (364), the second horizontal gate (412) is configured to latch to the ceiling by one or more ceiling latch catches configured to enable latching by one or more of the plurality of ceiling latches coupled to the ceiling (364), and the third horizontal gate (416) is configured to latch to the ceiling by one or more ceiling latch catches configured to enable latching by one or more of the plurality of ceiling latches coupled to the ceiling (364).

Embodiment 39

The method of Embodiment 38, further comprising: closing a first loading (420) door having a first length; and closing a second loading door (422) having a second length, different from the first length.

Embodiment 40

The method of Embodiment 22, wherein: the first plurality of foldable portions (414) comprises three foldable portions, the second plurality of foldable portions (412) comprises three foldable portions, and the third plurality of foldable portions (416) comprises three foldable portions.

Embodiment 41

The method of Embodiment 22, wherein: the container has a length of approximately 8 feet, the container has a width of approximately 8 feet, and the container has a height of approximately 8 feet.

Embodiment 42

The method of Embodiment 22, wherein: each of the first plurality of foldable portions is coupled to another foldable portion of the first plurality of foldable portions by one or more first horizontal gate hinges (415), each of the second plurality of foldable portions is coupled to another foldable portion of the second plurality of foldable portions by one or more second horizontal gate hinges (415), each of the third plurality of foldable portions is coupled to another foldable portion of the third plurality of foldable portions by one or more third horizontal gate hinges (415), and each of the fourth plurality of foldable portions is coupled to another foldable portion of the fourth plurality of foldable portions by one or more first vertical gate hinges (466).

Embodiment 43

A container, comprising: a floor (362) comprising: a plurality of pallet jack guide channels (504, 508, 512, 516); and a plurality of pallet recesses (502, 506, 510, 514); a plurality of vertical walls (460, 462, 464) coupled to the floor; a ceiling (364) coupled to the plurality of vertical walls; a first horizontal gate (414) coupled to a first vertical wall (460) of the plurality of vertical walls and comprising a first plurality of foldable portions; a second horizontal gate (412) coupled to a second vertical wall (462) of the plurality of vertical walls and comprising a second plurality of foldable portions; a third horizontal gate (416) coupled to a third vertical wall (464) of the plurality of vertical walls and comprising a third plurality of foldable portions; and a first vertical gate (410) coupled to the ceiling and comprising a fourth plurality of foldable portions, wherein, when extended, the first horizontal gate (414), the second horizontal gate (412), the third horizontal gate (416), and the first vertical gate (410) form a plurality of separate cargo volumes (402, 404, 406, 408).

Embodiment 44

A container, comprising: a floor (362), comprising: a plurality of vertical walls (460, 462, 464) coupled to the floor; a ceiling (364) coupled to the plurality of vertical walls; a first horizontal gate (414) coupled to a first vertical wall (460) of the plurality of vertical walls and comprising a first plurality of foldable portions; a second horizontal gate (412) coupled to a second vertical wall (462) of the plurality of vertical walls and comprising a second plurality of foldable portions; a third horizontal gate (416) coupled to a third vertical wall (464) of the plurality of vertical walls and comprising a third plurality of foldable portions; and a first vertical gate (410) coupled to the ceiling and comprising a fourth plurality of foldable portions, wherein: when extended, the first horizontal gate (414), the second horizontal gate (412), the third horizontal gate (416), and the first vertical gate (410) form a plurality of separate cargo volumes (402, 404, 406, 408), and when latched together, the first horizontal gate (414), the second horizontal gate (412), and the third horizontal gate (416) form a support column (218) in the container.

The preceding description is provided to enable any person skilled in the art to practice the various embodiments described herein. The embodiments and examples discussed herein are not limiting of the scope, applicability, or embodiments set forth in the claims. Various modifications to these embodiments will be readily apparent to those skilled in the art, and the generic principles defined herein may be applied to other embodiments. For example, changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

As used herein, the word "exemplary" means "serving as an example, instance, or illustration." Any aspect described herein as "exemplary" is not necessarily to be construed as preferred or advantageous over other aspects.

As used herein, the word "coupled" and variants thereof mean to join, fasten, connect, or link things together, either directly or indirectly.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The following claims are not intended to be limited to the embodiments shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for" or, in the case of a method claim, the element is recited using the phrase "step for." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A container, comprising:

a floor;

a plurality of vertical walls attached to the floor;

a ceiling attached to the plurality of vertical walls;

a first horizontal gate attached to a first vertical wall of the plurality of vertical walls and comprising a first plurality of foldable portions;

a second horizontal gate attached to a second vertical wall of the plurality of vertical walls and comprising a second plurality of foldable portions;

a third horizontal gate attached to a third vertical wall of the plurality of vertical walls and comprising a third plurality of foldable portions; and a first vertical gate attached to the ceiling and comprising a fourth plurality of foldable portions, wherein, when extended, the first horizontal gate, the second horizontal gate, the third horizontal gate, and the first vertical gate form a plurality of separate cargo volumes.

2. The container of claim 1, wherein:

the first horizontal gate is configured to latch to the floor, the second horizontal gate is configured to latch to the floor, the third horizontal gate is configured to latch to the floor, and the first vertical gate is configured to latch to the floor.

3. The container of claim 2, wherein:

the first horizontal gate is configured to latch to the ceiling, the second horizontal gate is configured to latch to the ceiling, and the third horizontal gate is configured to latch to the ceiling.

4. The container of claim 3, wherein the second horizontal gate is configured to latch to the first horizontal gate.

5. The container of claim 4, wherein:

the second horizontal gate comprises a horizontal gate extension attached to the second horizontal gate by one or more horizontal extension hinges, the horizontal gate extension is configured to latch to the floor, and the horizontal gate extension is configured to latch to the ceiling.

6. The container of claim 5, wherein:

the third horizontal gate is configured to latch to the first horizontal gate, and the third horizontal gate is configured to latch to the horizontal gate extension.

7. The container of claim 6, wherein, when latched together, the first horizontal gate, the second horizontal gate, and the third horizontal gate form a support column in the container.

8. The container of claim 7, wherein the first vertical gate is configured to latch to the third horizontal gate.

9. The container of claim 1, wherein the floor comprises a plurality of pallet jack guide channels.

10. The container of claim 9, wherein:

a first pair of pallet jack guide channels of the plurality of pallet jack guide channels is configured to guide a pallet jack to a first cargo area, a second pair of pallet jack guide channels of the plurality of pallet jack guide channels is configured to guide the pallet jack to a second cargo area, a third pair of pallet jack guide channels of the plurality of pallet jack guide channels is configured to guide the pallet jack to a third cargo area, and a fourth pair of pallet jack guide channels of the plurality of pallet jack guide channels is configured to guide the pallet jack to a fourth cargo area.

11. The container of claim 1, wherein the floor comprises a plurality of pallet recesses.

12. The container of claim 11, wherein:

a first set of pallet recesses of the plurality of pallet recesses reside in a first cargo area in a first pallet orientation direction, a second set of pallet recesses of the plurality of pallet recesses reside in a second cargo area in a second pallet orientation direction, a third set of pallet recesses of the plurality of pallet recesses reside in a third cargo area in the first pallet orientation direction, and a fourth set of pallet recesses of the plurality of pallet recesses reside in a fourth cargo area in the second pallet orientation direction.

13. The container of claim 1, wherein:

the first horizontal gate is attached to the first vertical wall of the plurality of vertical walls by a first hinge attached to a first vertical post attached to the first vertical wall, the second horizontal gate is attached to the second vertical wall of the plurality of vertical walls by a second hinge attached to a second vertical post attached to the second vertical wall, and the third horizontal gate is attached to the third vertical wall of the plurality of vertical walls by a third hinge attached to a third vertical post attached to the third vertical wall.

14. The container of claim 1, wherein:

at least one of the first plurality of foldable portions in the first horizontal gate comprises a first truss structure, at least one of the second plurality of foldable portions in the second horizontal gate comprises a second truss structure, and at least one of the third plurality of foldable portions in the third horizontal gate comprises a third truss structure.

15. The container of claim 1, wherein:

at least one of the first plurality of foldable portions in the first horizontal gate comprises a first diagonal support structure, at least one of the second plurality of foldable portions in the second horizontal gate comprises a second diagonal support structure, and at least one of the third plurality of foldable portions in the third horizontal gate comprises a third diagonal support structure.

16. The container of claim 2, wherein:

the first horizontal gate is configured to latch to the floor by one or more floor latch catches configured to enable latching by one or more of a plurality of floor latches attached to the floor, the second horizontal gate is configured to latch to the floor by one or more floor latch catches configured to enable latching by one or more of the plurality of floor latches attached to the floor, the third horizontal gate is configured to latch to the floor by one or more floor latch catches configured to enable latching by one or more of the plurality of floor latches attached to the floor, and the first vertical gate is configured to latch to the floor by one or more floor latch catches configured to enable latching by one or more of a plurality of floor latches attached to the floor.

17. The container of claim 2, wherein:

the first horizontal gate is configured to latch to the ceiling by one or more ceiling latch catches configured to enable latching by one or more of a plurality of ceiling latches attached to the ceiling, the second horizontal gate is configured to latch to the ceiling by one or more ceiling latch catches configured to enable latching by one or more of the plurality of ceiling latches attached to the ceiling, and the third horizontal gate is configured to latch to the ceiling by one or more ceiling latch catches configured to enable latching by one or more of the plurality of ceiling latches attached to the ceiling.

18. The container of claim 1, further comprising:

a first loading door having a first length; and a second loading door having a second length, different from the first length.

19. The container of claim 1, wherein:

the first plurality of foldable portions comprises three foldable portions, the second plurality of foldable portions comprises three foldable portions, and the third plurality of foldable portions comprises three foldable portions.

20. The container of claim 1, wherein:

the container has a length of approximately 8 feet, the container has a width of approximately 8 feet, and the container has a height of approximately 8 feet.

21. The container of claim 1, wherein:

each of the first plurality of foldable portions is attached to another foldable portion of the first plurality of foldable portions by one or more first horizontal gate hinges, each of the second plurality of foldable portions is attached to another foldable portion of the second plurality of foldable portions by one or more second horizontal gate hinges, each of the third plurality of foldable portions is attached to another foldable portion of the third plurality of foldable portions by one or more third horizontal gate hinges, and each of the fourth plurality of foldable portions is attached to another foldable portion of the fourth plurality of foldable portions by one or more first vertical gate hinges.

22. A container, comprising:

a floor comprising:

a plurality of pallet jack guide channels; and a plurality of pallet recesses;

a plurality of vertical walls attached to the floor;

a ceiling attached to the plurality of vertical walls;

a first horizontal gate attached to a first vertical wall of the plurality of vertical walls and comprising a first plurality of foldable portions;

a second horizontal gate attached to a second vertical wall of the plurality of vertical walls and comprising a second plurality of foldable portions;

a third horizontal gate attached to a third vertical wall of the plurality of vertical walls and comprising a third plurality of foldable portions; and a first vertical gate attached to the ceiling and comprising a fourth plurality of foldable portions, wherein, when extended, the first horizontal gate, the second horizontal gate, the third horizontal gate, and the first vertical gate form a plurality of separate cargo volumes.

23. A container, comprising:

a floor;

a plurality of vertical walls attached to the floor;

a ceiling attached to the plurality of vertical walls;

a first horizontal gate attached to a first vertical wall of the plurality of vertical walls and comprising a first plurality of foldable portions;

a second horizontal gate attached to a second vertical wall of the plurality of vertical walls and comprising a second plurality of foldable portions;

a third horizontal gate attached to a third vertical wall of the plurality of vertical walls and comprising a third plurality of foldable portions; and a first vertical gate attached to the ceiling and comprising a fourth plurality of foldable portions, wherein:

when extended, the first horizontal gate, the second horizontal gate, the third horizontal gate, and the first vertical gate form a plurality of separate cargo volumes, and when latched together, the first horizontal gate, the second horizontal gate, and the third horizontal gate form a support column in the container.

* * * * *